US006234699B1

(12) United States Patent
Brode

(10) Patent No.: US 6,234,699 B1
(45) Date of Patent: May 22, 2001

(54) PLANT WRITING APPARATUS

(76) Inventor: Beverly Brode, 25870 Woodlore, Franklin, MI (US) 48025

( * ) Notice: Subject to any disclaimer, the term of this patent is extended or adjusted under 35 U.S.C. 154(b) by 0 days.

(21) Appl. No.: 09/532,243

(22) Filed: Mar. 22, 2000

(51) Int. Cl.[7] ..... B43K 29/00
(52) U.S. Cl. ..... 401/195; 401/52; D19/42
(58) Field of Search ..... 401/52, 195; D19/42, D19/54, 57, 58

(56) References Cited

U.S. PATENT DOCUMENTS

D. 179,634 * 2/1957 Gemora ..... D19/42
D. 328,310 * 7/1992 Yoshinaga ..... D19/42
D. 354,984 * 1/1995 Tsuji ..... 401/195
D. 388,824 * 1/1998 Harper ..... D19/42
D. 390,602 * 2/1998 Frank ..... D19/42
2,765,509 * 10/1956 Brehm ..... D19/42
4,678,206 * 7/1987 Leahan ..... 401/195
5,308,179 * 5/1994 Whitright ..... D19/42

OTHER PUBLICATIONS

"Koosh Pencil Topper", Washington Post, p. C5, Dec. 1995.*

* cited by examiner

*Primary Examiner*—Charles R. Eloshway
(74) *Attorney, Agent, or Firm*—Gifford, Krass, Groh, Sprinkle, Anderson & Citkowski, P.C.

(57) ABSTRACT

A writing apparatus constructed in the shape of a flower. A stem has a writing instrument attached at one end and a decorative flowering arrangement at the other end. The stem may be wrapped with colored paper or tape to give the writing apparatus the appearance of a natural flower.

2 Claims, 1 Drawing Sheet

PLANT WRITING APPARATUS

FIELD OF THE INVENTION

The present invention concerns a writing apparatus. More specifically, the present invention is directed to a writing apparatus designed to give the appearance of a flowering plant.

BACKGROUND OF THE INVENTION

The pen and pencil have been in use by humankind for many hundreds of years. While the origin and design of these simple writing tools is uncertain, it is certainly true that over the years pens and pencils have been seen in a marvelous variety of configurations. One of the most fanciful of these types of instruments is the colonial age quill pen. More modern designs include the popular number 2 size pencil manufactured by the Dixon Ticonderoga company, the Bic company's disposable ballpoint pen, and the classic fountain pens manufactured by the Mont Blanc company.

However despite the wide array of writing instruments to choose from, the overall designs of these instruments is uninspired. This lack of design creativity has resulted in a significant secondary market of decorative erasers, pen lights, and other novelty type devices for persons interested in making a statement beyond those on paper.

SUMMARY OF THE INVENTION

The present invention is a writing apparatus constructed so as to mimic the appearance of a flowering plant. The invention includes an elongated stem portion having a pen or pencil disposed in its base. Flower petals are arranged at the top of the stem opposite the base portion so as to give the appearance of a flowering plant. The base and flowering portion are fixedly attached to the stem through the use of colored tape and may alternatively include an arrangement of artificial leaves interspaced between the pen portion and the flower portion.

DESCRIPTION OF THE DRAWING

A better understanding is available through reference to the drawings, the figures of which depict as follows.

DETAILED DESCRIPTION

Figure 2:
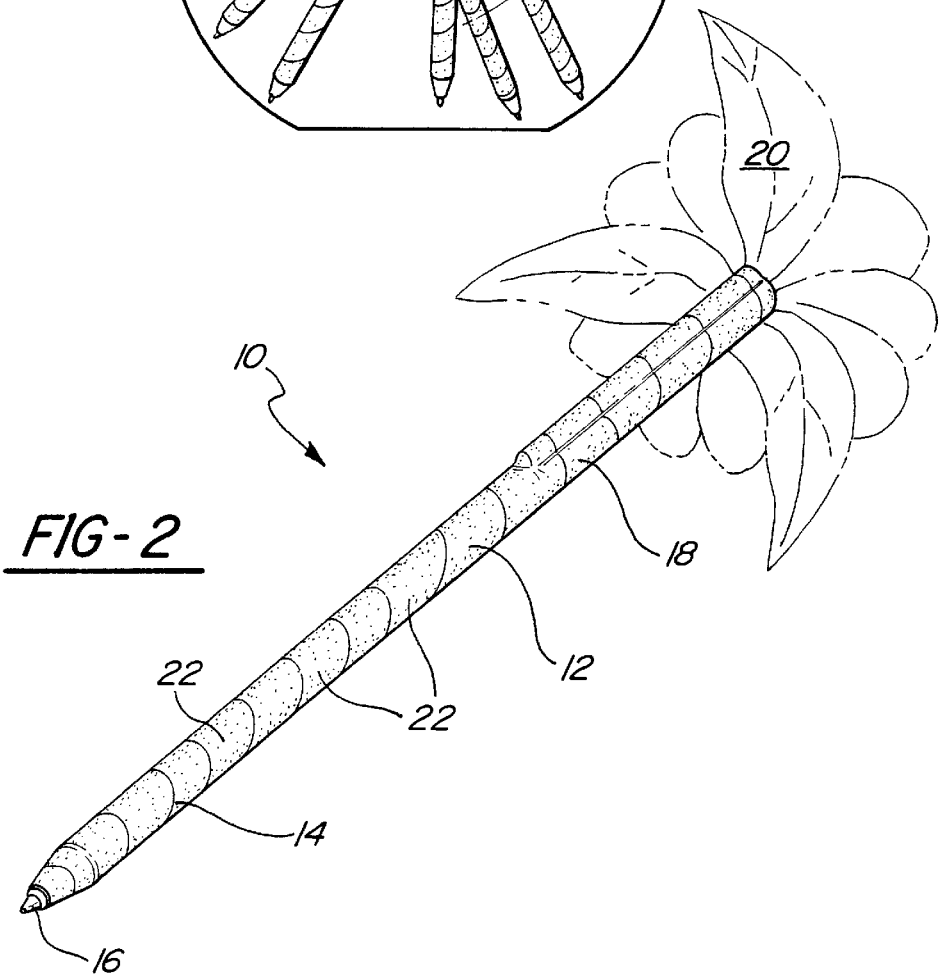
FIG. 2 is a perspective view of a plurality of writing apparatus of the present invention in the form of a flower arrangement.

As seen in FIG. 2, the present invention is a writing apparatus constructed to mimic the appearance of a flowering plant. The writing apparatus 10 includes an elongated stem portion 12. The stem portion 12 is preferably constructed of a thin gage metal wire but may alternatively be constructed of other materials such as plastic or cardboard which have the necessary characteristics of flexibility and durability.

A conventional writing instrument 14 is disposed at the base of the stem. Alternatively, the writing apparatus body may constitute the entire stem of the invention. The writing apparatus may be of conventional design and includes a writing tip portion 16 and a handle portion 18. The writing instrument may be fixedly attached to the stem portion 12 as will be described below. Alternatively, the stem portion may be hollow with the writing apparatus being disposed within the stem and the writing tip portion extending outwardly from the base portion.

A flower petal arrangement 20 is disposed on the opposite end of the stem from the writing instrument. Preferably, the petal arrangement is constructed of silk or silk-like fabric; however, other materials such as plastic and paper may also be utilized. The petal arrangement may be affixed to the stem portion 12 by glue or adhesive or as will be described below.

The writing instrument 14 and petal arrangement 20 may be affixed to the stem 12 with colored tape 22 or similar type material. In those instances where the stem material is not of a natural shade, colored tape in the shade of a brown or a green will provide the writing apparatus of the present invention with a more natural appearance. Additionally, artificial leaves may be attached to the stem portion between the base and petal arrangement. The leaf arrangement may be constructed of a material similar to the petal arrangement.

Figure 1:
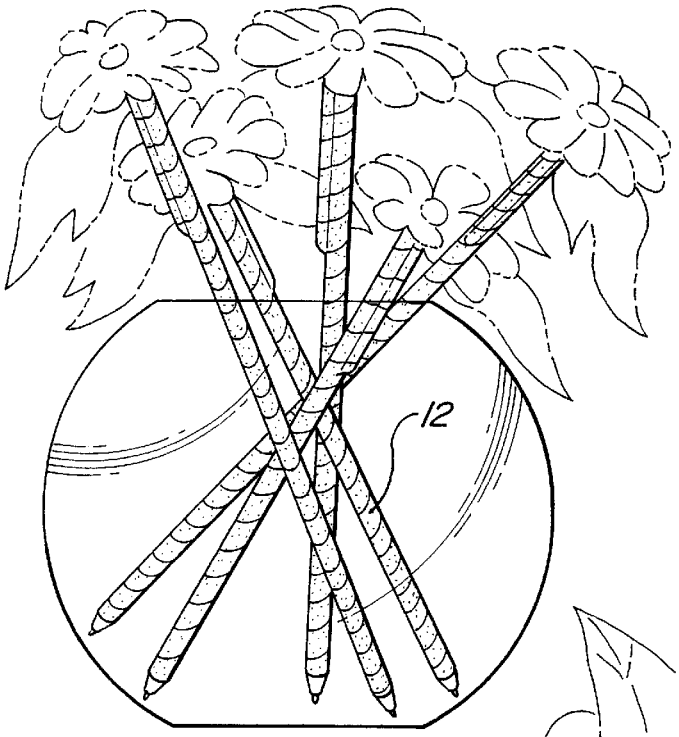
FIG. 1 is a perspective view of a writing device constructed in accordance with the present invention.

With reference now to FIG. 1, a plurality of writing apparatus as disclosed by the present invention is shown as an arrangement of flowers contained in a flower vase. Displayed in this manner the invention provides a pleasing aesthetic quality to any environment.

Having described my invention, it will become apparent that other embodiments will be obvious to those skilled in the art. For example, the petaled end of the stem may be bifurcated such that a plurality of flowers may be placed on a single stem. Additionally, inventors may manipulate the flower petal color in order to match the writing color of the writing apparatus.

I claim:

1. A writing apparatus comprising:

a writing instrument, said instrument having a writing end and a body portion;

an elongated stem portion having an end and being constructed of a thin gage metal wire;

a flower petal head portion secured to said end of said stem portion;

at least one synthetic leaf secured to the elongated stem portion; and an adhesive tape wrapped around the writing instrument and securing said elongated stem portion to the entire length of the writing instrument.

2. The writing instrument of claim 1 wherein said adhesive tape has a colored non-adhesive surface.

* * * * *